US005942145A

United States Patent [19]

Jeon et al.

[11] Patent Number: 5,942,145

[45] **Date of Patent: *Aug. 24, 1999**

[54] DRIVING CIRCUIT OF TURNTABLE MOTOR IN MICROWAVE OVEN

[75] Inventors: Nam-Sik Jeon; Yoon-Gon Kim, both of Kyungki-Do, Rep. of Korea

[73] Assignee: Samsung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/766,826

[22] Filed: Dec. 13, 1996

[30] Foreign Application Priority Data

| | | | |
|---|---|---|---|
| Dec. 21, 1995 | [KR] | Rep. of Korea | 95-72263 |
| Jul. 18, 1996 | [KR] | Rep. of Korea | 96-28990 |
| Oct. 30, 1996 | [KR] | Rep. of Korea | 96-49966 |

[51] Int. Cl.[6] ..... H05B 6/66; H05B 6/78

[52] U.S. Cl. ..... 219/754; 219/715; 219/760; 219/757

[58] Field of Search ..... 219/754, 755, 219/753, 760, 715, 716, 717, 757

[56] References Cited

U.S. PATENT DOCUMENTS

| | | | |
|---|---|---|---|
| 3,341,723 | 9/1967 | Tourtellot | 310/68 R |
| 3,612,675 | 10/1971 | Ruta | 353/15 |
| 4,121,079 | 10/1978 | Harmon | 219/715 |
| 4,219,715 | 8/1980 | Mandle et al. | 219/755 |
| 4,308,445 | 12/1981 | Offutt | 219/755 |
| 4,383,156 | 5/1983 | Furusawa | 219/715 |
| 4,517,432 | 5/1985 | Ishii et al. | 219/755 |
| 4,762,463 | 8/1988 | Yang | 416/61 |
| 4,812,607 | 3/1989 | Cornell | 219/760 |
| 4,937,513 | 6/1990 | Hoemann et al. | 318/772 |

FOREIGN PATENT DOCUMENTS

| | | | |
|---|---|---|---|
| 52-64032 | 5/1977 | Japan | 219/760 |

*Primary Examiner*—Philip H. Leung

*Attorney, Agent, or Firm*—Burns, Doane, Swecker & Mathis, L.L.P.

[57] ABSTRACT

The invention relates to an apparatus and method for operating a turntable motor in a microwave oven. The inventive system includes a transformation of a commercial power supply into a lower voltage power source for application to the turntable motor when the turntable motor is operated in response to a control signal.

4 Claims, 7 Drawing Sheets

DRIVING CIRCUIT OF TURNTABLE MOTOR IN MICROWAVE OVEN

BACKGROUND OF THE INVENTION

1. Field of the Invention

The present invention relates in general to a driving circuit of a turntable motor in microwave oven, and more particularly to a driving circuit for driving a turntable motor which is operated at a low voltage.

2. Description of the Prior Art

Generally, microwave ovens utilize microwaves when cooking food. In other words, when the microwaves are applied to food molecules in the water and other frictional heat is generated therefrom. As a result, the food is heated by the frictional heat.

The microwaves are generated by a magnetron which performs an oscillating operation at a fundamental frequency. FIGS. 7 and 8 show such a microwave oven for performing a cooking operation by heating the food with the microwaves generated by the magnetron. As shown in this drawings, the microwave oven includes a magnetron 20, a high voltage transformer 10 (hereinafter referred to as HVT) connected to the magnetron 20 for applying a high voltage to the magnetron 20, a lamp for lighting an inside of a cooking chamber 40, a turntable motor 50 for rotating a turntable 60 so that food can be evenly cooked during the operation of the magnetron 20, a fan motor 80 for cooling the magnetron 20 and circulating air in the cooking chamber 40 during the operation of the magnetron 20. Referring to FIG. 8, also included is a relay 120 and a relay 130 which are turned on/off to control an alternating current (referred to hereinafter as AC) power supplied to a lamp (not shown), a turn turntable motor 50, a fan motor 80, and the like.

Unexplained reference number 110 is a switch for stopping the operation of the magnetron 20 when a microwave door (not shown) is open.

However, there is a problem in the conventional microwave oven according to the prior art thus constructed, in that the turntable motor driving circuit is designed only for receiving a commonly used AC power supply, thereby necessitating an unnecessary large turntable motor, so that production costs and power consumption are increased.

SUMMARY OF THE INVENTION

Accordingly, the present invention is provided to solve afore-mentioned problem and it is an object of the present invention to provide a driving circuit of a turntable motor which is operated at a low voltage.

In accordance with the object of the present invention, there is provided a driving circuit of a turntable motor which is operated at a low voltage, the apparatus comprising:

voltage changing means for changing a commonly used AC power supply to generate a predetermined low voltage;

control means for generating a control signal according to a key signal; and switching means responsive to the control signal for selectively supplying a low voltage generated from the voltage changing means to a turntable driving means according to the control signal generated from the control means.

BRIEF DESCRIPTION OF THE DRAWINGS

For the fuller understanding of the nature and objects of the invention, reference should be made to the following detailed description taken in conjunction with the accompanying drawings in which.

DETAILED DESCRIPTION OF THE INVENTION

A driving circuit for a turntable motor in the microwave oven according to the preferred embodiment of the present invention will be described in detail with reference to the accompanying drawings.

Figure 1:
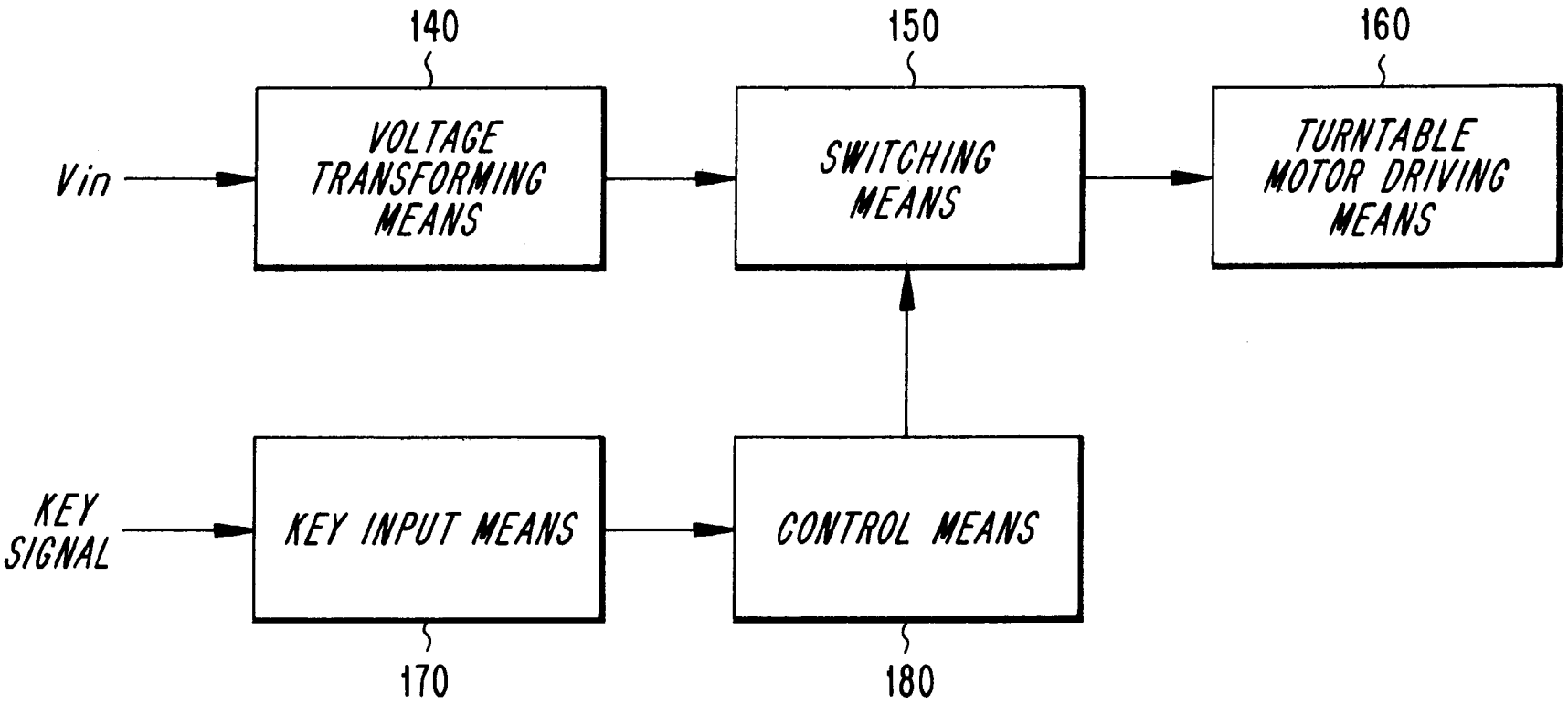
FIG. 1 is a block diagram for illustrating a driving circuit of a turntable motor in a microwave oven according to the present invention.

FIG. 1 is a block diagram illustrating a driving circuit of a turntable motor in the microwave oven.

As shown in FIG. 1, the block diagram includes voltage transforming means 140 for transforming a common used AC power supply from outside to a predetermined low level voltage.

Control means 180 receives a key signal from key input means 170 and generates a control signal to switching means 150.

The switching means 150 selectively supplies a predetermined low level voltage to turntable motor driving means 160 according to a control signal generated by the control means 180.

Next, operation of a driving circuit of a turntable motor in the microwave oven according to the present invention thus constructed will be described.

When electric power is applied from an electric power supply (not shown), and a user then pushes a start cooking button at the key input means 170, a cooking start command is output from the key input means 170 to the control means 180 where the control means serves to generate a control signal to the switching means 150.

According to the control signal, the switching means 150 executes switching operations so as to supply a predetermined low level voltage generated from the voltage transforming means 140 to the turntable motor driving means 160.

Therefore, the turntable motor is rotated according to the turntable motor driving means 160 to which a predetermined low voltage is applied from the voltage transforming means 140.

Next, when the user pushes an end cooking button at the key input means 170, or when a predetermined cooking time elapses, the control means 180 generates a control signal to the switching means 150 so that a predetermined low level voltage generated from the voltage transforming means 140 is not supplied to the turntable motor driving means 160.

Therefore, the predetermined low level voltage is not supplied to the turntable motor driving means 160, and the turntable 60 is no longer rotated.

FIG. 2 through FIG. 5 are circuit diagrams illustrating an embodiment of the present invention.

The embodiment of the present invention will now be described in detail with reference to the accompanying drawings.

Figure 2:
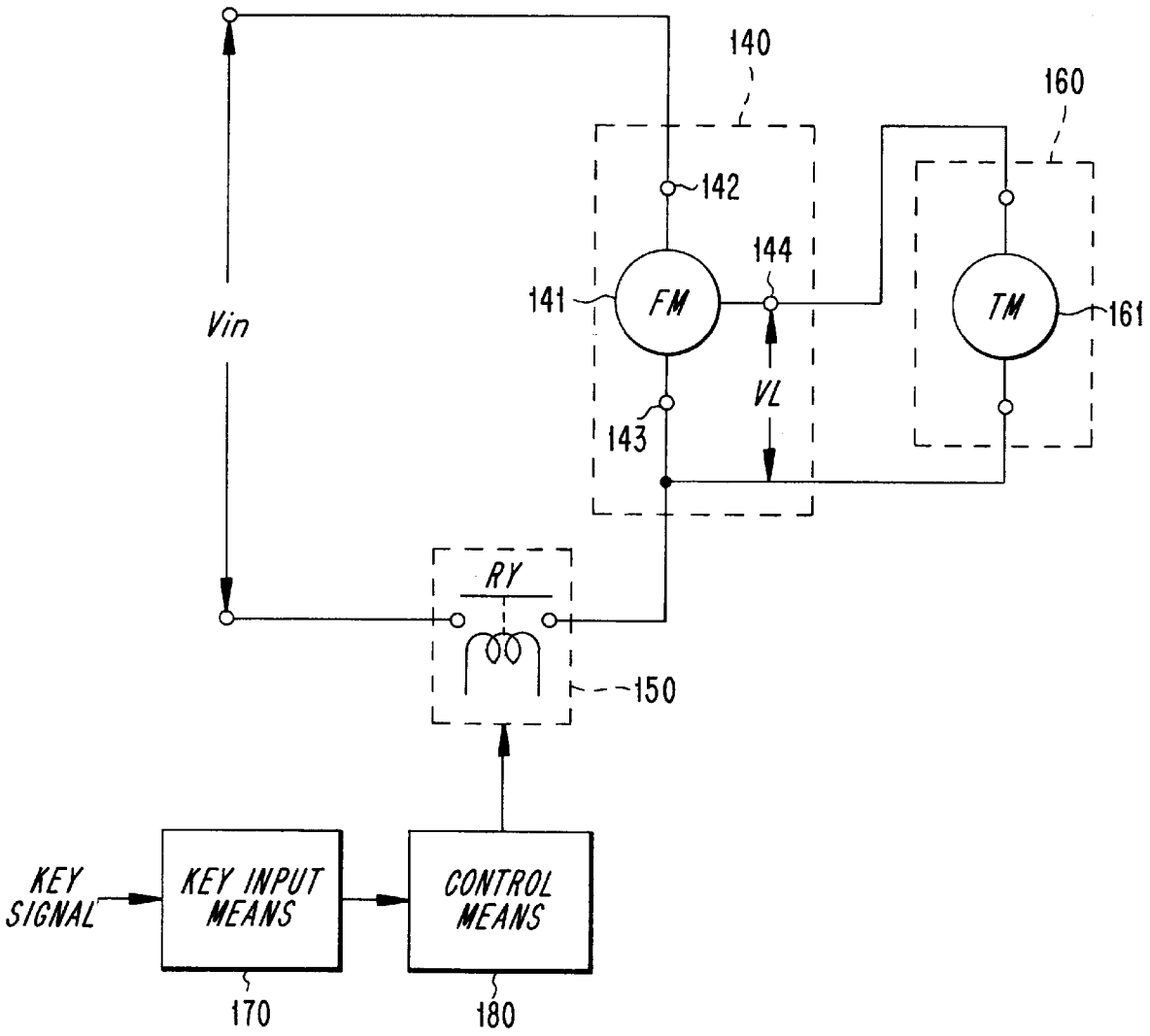
FIG. 2 is a circuit diagram for illustrating an embodiment of the present invention.

Referring to the FIG. 2, a common AC power supply Vin is supplied to a fan motor 141 according to a control signal generated by a control means 180.

Successively, a predetermined low level voltage is supplied to the turntable motor 161 through a low voltage output terminal 144, and thereby the turntable motor 161 is rotated.

Figure 3:
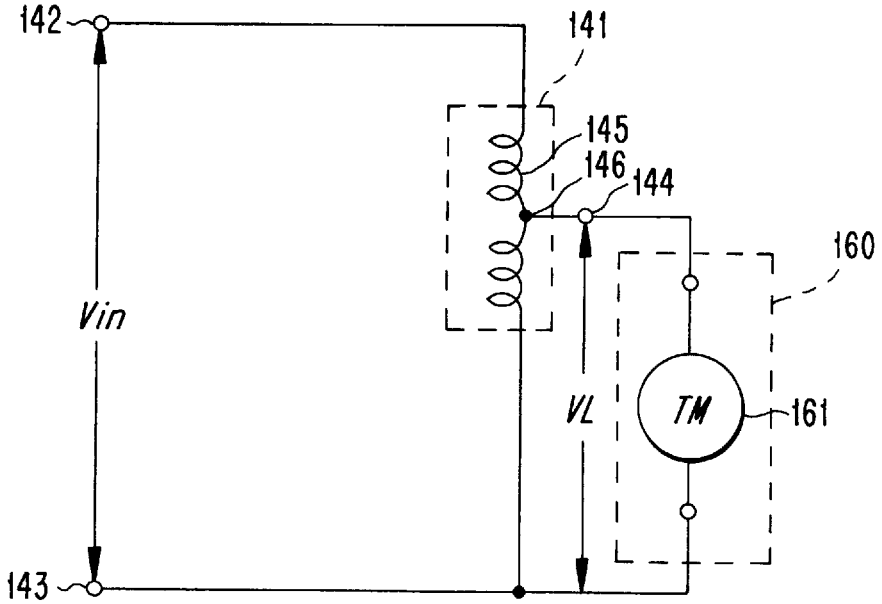
FIG. 3 is a circuit diagram between a fan motor and a turntable motor.
Figure 4:
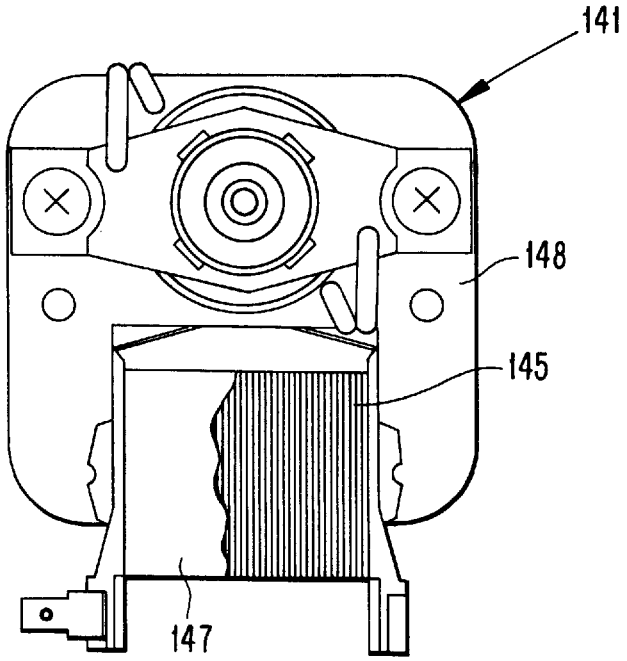
FIG. 4 is a sectional view for illustrating a fan motor.

Meanwhile, as is shown in FIG. 3, a tap 146 is connected to a stator coil 145, an output voltage generated from the tap terminal 146 is transformed to a predetermined low level voltage $V_L$, and it is supplied to the turntable motor 161.

Figure 5:
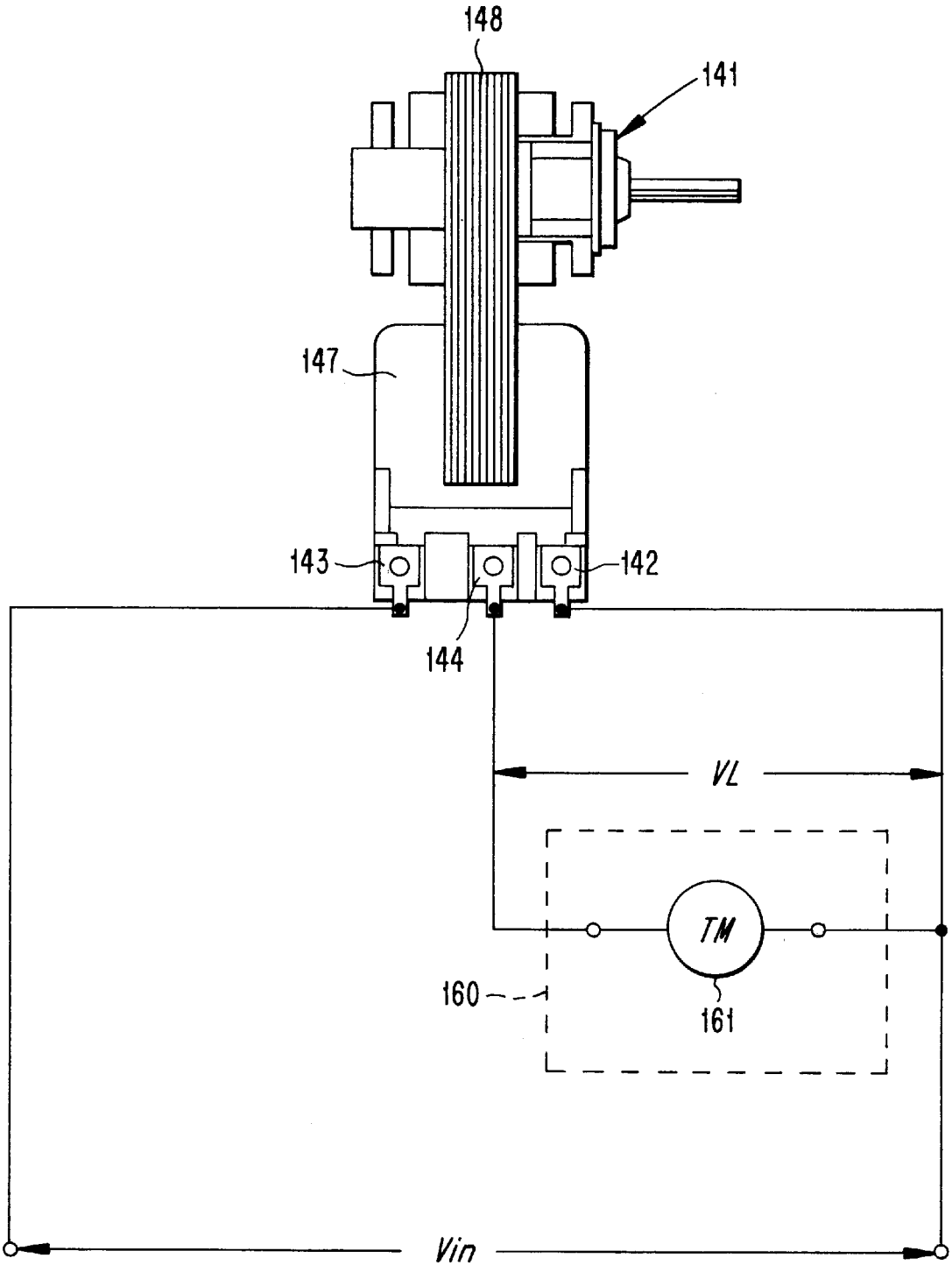
FIG. 5 is a sectional view for illustrating a partially broken fan motor and a turntable motor connected to the fan motor.

Furthermore, as is shown in FIG. 5, the common AC power supply (not shown) is applied to the stator coil 145 through an input terminal 142, 143, and a predetermined low level voltage which is transformed by the low voltage output terminal 144 is applied to the turntable motor through the low voltage output terminal 144.

Next, the operation of a driving circuit for a turntable motor in a microwave oven according to the present invention thus constructed will be described in detail. When the user pushes a cooking start button at the key input means 170 and a cooking start command is output from the key input means 170 to the control means 180, the control means generates a control signal to thereby turn on a relay $R_Y$.

Meanwhile, as the tap 146 is connected to the stator coil 145, an output voltage generated from the tap terminal 146, that is a low level voltage $V_L$, is applied to the turntable motor 161, and the turntable motor 161 is driven to rotate.

Next, when the user pushes a cooking end button at the key input means 170 or when a predetermined cooking time elapses, the control means 180 then generates a control signal to the switching means 150 so that a predetermined low level voltage generated from the voltage transforming means 140 may not be supplied to the turntable motor 161 and the fan motor 141.

Figure 6:
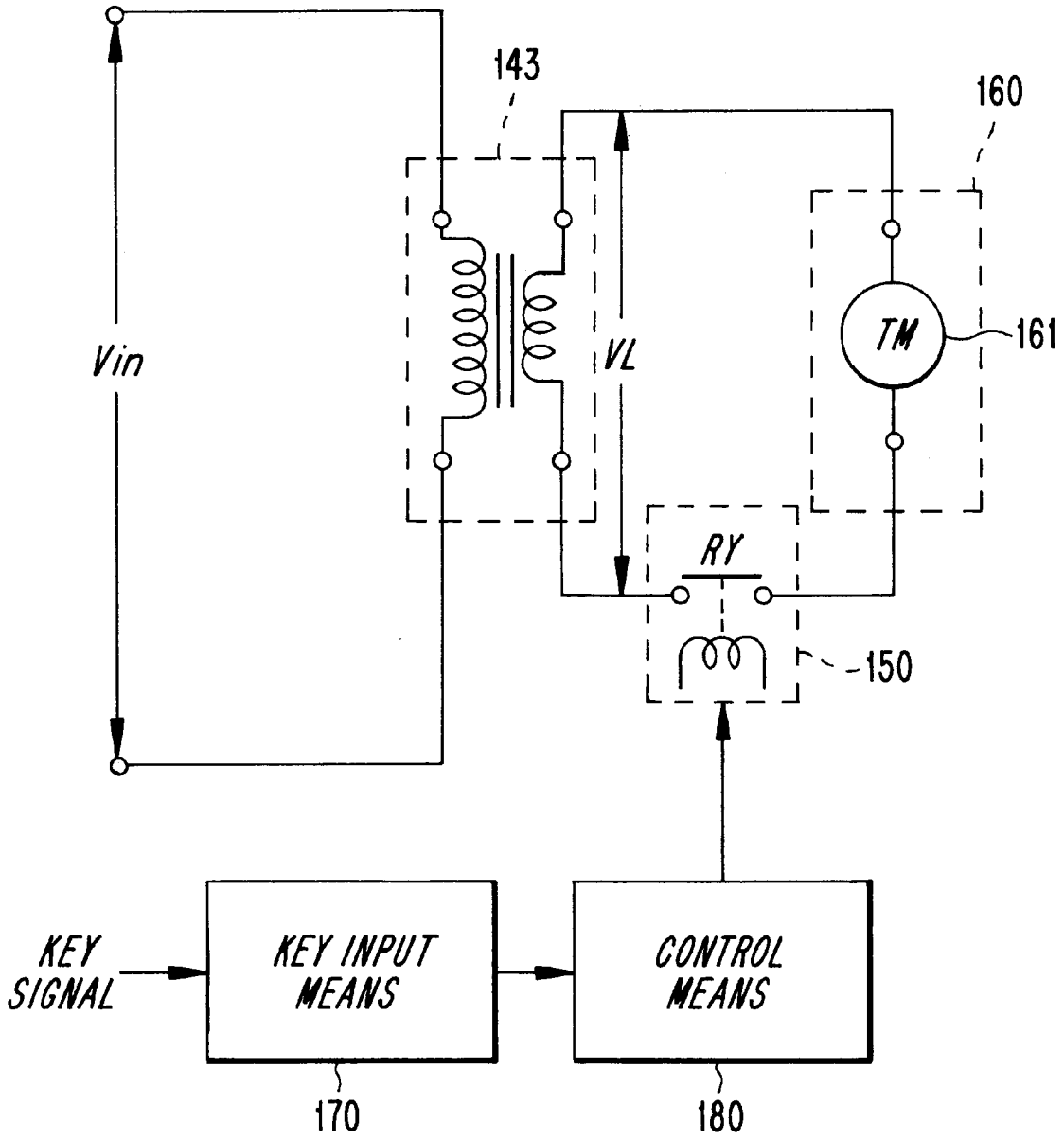
FIG. 6 is a circuit diagram for illustrating another embodiment of the present invention.
Figure 7:
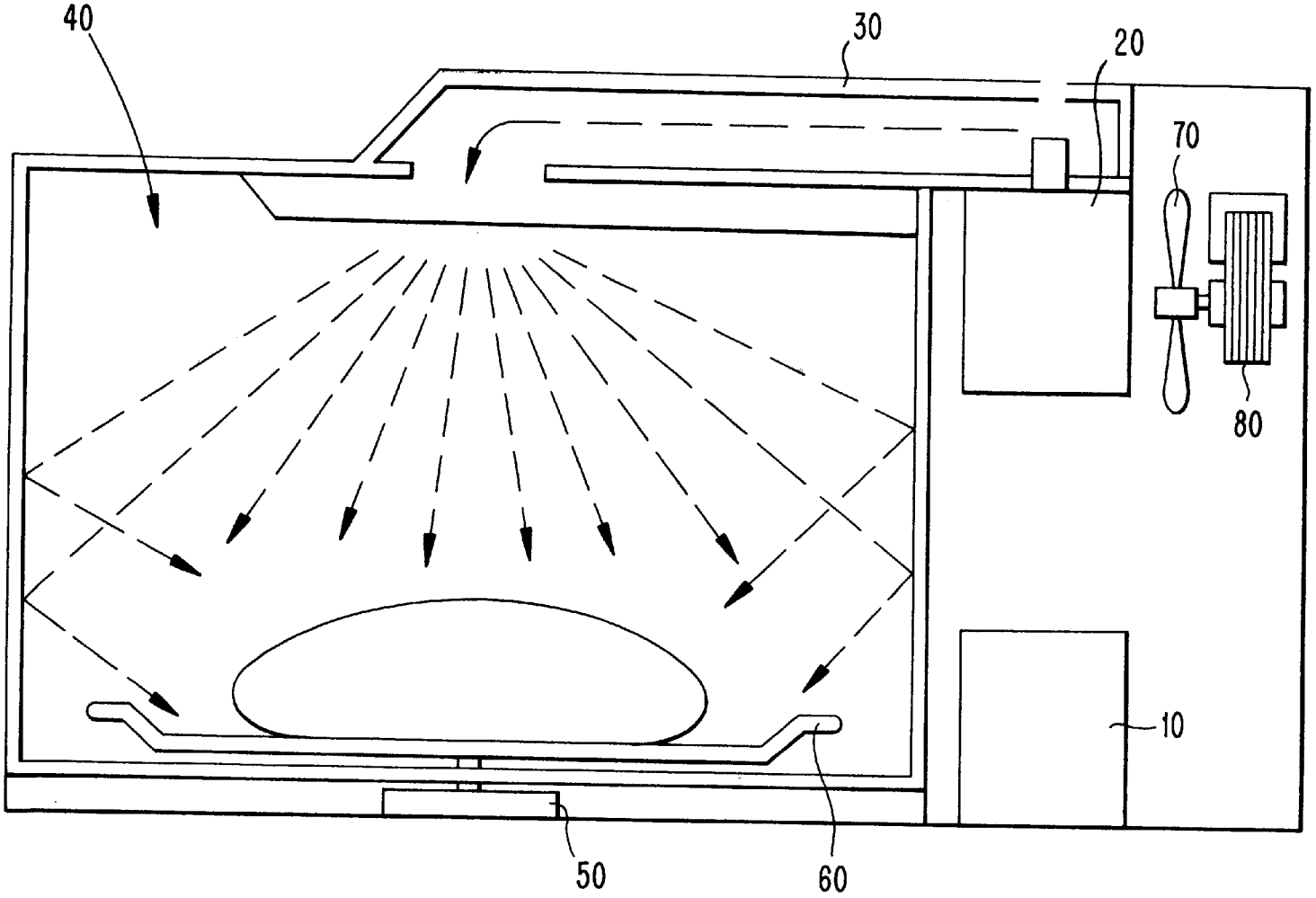
FIG. 7 (PRIOR ART)
FIG. 7 is a sectional view of a microwave oven according to the prior art.
Figure 8:
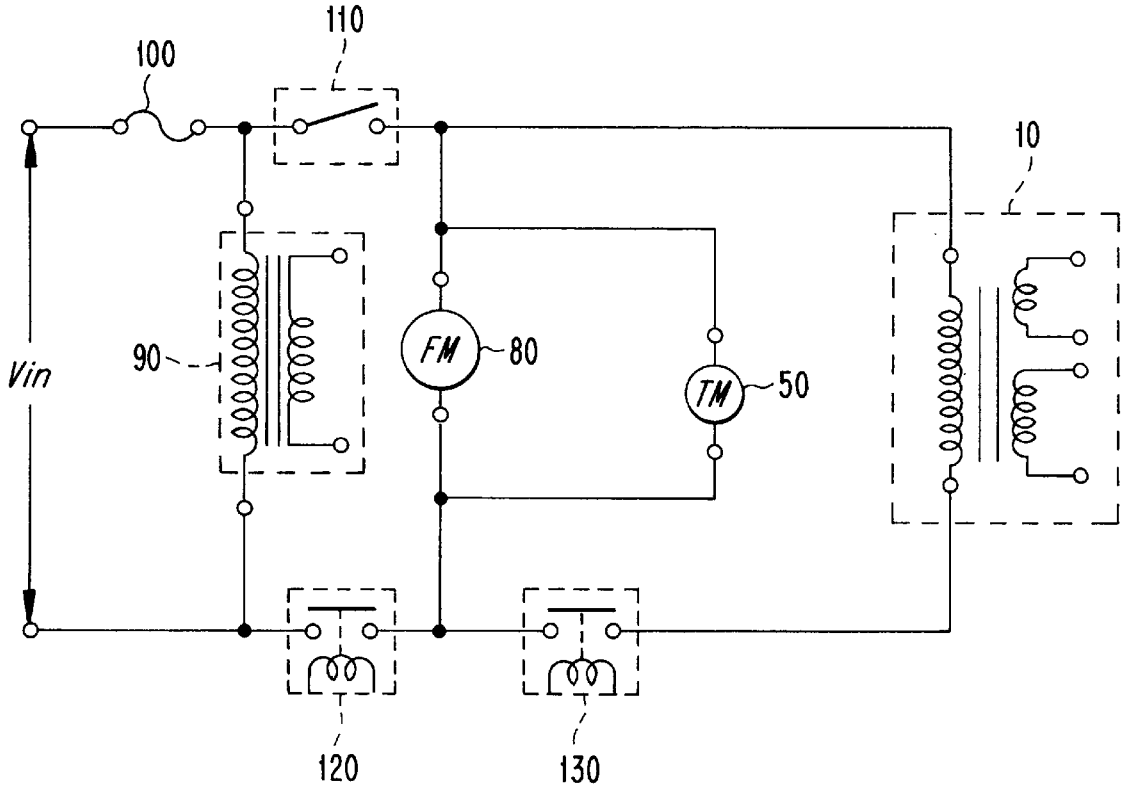
FIG. 8 (PRIOR ART)
FIG. 8 is a circuit diagram for illustrating a motor driving circuit according to the prior art.

Furthermore, FIG. 6 is a circuit diagram for illustrating another embodiment of the present invention.

Referring to the FIG. 6, common AC power supply is transformed to a predetermined low level voltage 21 volts, for example by the low-voltage transformer 143.

Subsequently, a low level voltage $V_L$ transformed by the low-voltage transformed 143 is selectively applied to the turntable motor 161 according to a switching operation of the relay $R_Y$ controlled by a control signal generated from the control means 180.

Successively, the turntable motor which receives a low level voltage from the low-voltage transform 143 is driven to rotate.

Next, when the user pushes a cooking end button or when a predetermined cooking time elapses, the control means 180 then generates a control signal to the switching means, such as relay $R_Y$, so that a predetermined low level voltage generated from the low-voltage transformer 143 may not be supplied to the turntable motor 161, and subsequently the turntable motor 161 is stopped.

As is apparent from the above, there is an advantage in a driving circuit of a turntable motor in the microwave oven according to the embodiment of the present invention, in that a turntable motor is driven to be rotated at a low level voltage which is transformed by voltage transforming means, and in that production costs can be cut down, and also in that consumed AC power can be decreased.

What is claimed is:

1. A driving circuit for a turntable motor in a microwave oven including a magnetron for generating a microwave during a cooking operation, a fan motor for cooling the magnetron and a turntable motor for rotating foods in the cooking chamber, the circuit comprising:

voltage changing means for transforming a common AC power supply into a low level voltage to drive the turntable motor and consisting of a tap mounted to a stator coil of the fan motor.

2. The circuit in accordance with claim 1, wherein the low voltage generated from the voltage changing means is about 21 volts.

3. The Circuit as defined in claim 1, wherein the circuit further comprises:

control means for generating a control signal that is supplied to a switching means according to a key signal generated from a key input means; and switching means for selectively supplying the common AC power to the stator coil of the fan motor according to the control signal.

4. The driving circuit as defined in claim 3, wherein the control means generates a control signal for driving off the turntable motor when the user pushes a cooking end button equipped at the key input means or when a predetermined cooking time elapses, so that a predetermined low voltage generated from the voltage changing means may not be supplied to the turntable motor.

* * * * *